US006283836B1

(12) United States Patent
Fruitman et al.

(10) Patent No.: US 6,283,836 B1
(45) Date of Patent: Sep. 4, 2001

(54) NON-ABRASIVE CONDITIONING FOR POLISHING PADS

(75) Inventors: Clinton Fruitman, Chandler; Mark Meloni, Tempe, both of AZ (US); John Natalicio, Los Angeles, CA (US)

(73) Assignee: SpeedFam-IPEC Corporation, Chandler, AZ (US)

( * ) Notice: Subject to any disclaimer, the term of this patent is extended or adjusted under 35 U.S.C. 154(b) by 0 days.

(21) Appl. No.: 09/264,067

(22) Filed: Mar. 8, 1999

(51) Int. Cl.[7] ..... B24B 29/00
(52) U.S. Cl. ..... 451/56; 451/285; 83/490
(58) Field of Search ..... 451/56, 159, 173, 451/285, 413, 443, 444, 548, 72; 83/43, 490, 491, 592, 607, 861

(56) References Cited

U.S. PATENT DOCUMENTS 4,198,887 * 4/1980 Williams, Jr. ..... 83/592 X
4,401,003 * 8/1983 Baldwin et al. ..... 83/490 X
4,567,802 * 2/1986 Witherspoon ..... 83/607 X
5,626,509 * 5/1997 Hayashi ..... 451/56 X
5,842,912 * 12/1998 Holzapfel et al. ..... 451/72

* cited by examiner

*Primary Examiner*—Derris H. Banks
*Assistant Examiner*—Anthony Ojini
(74) *Attorney, Agent, or Firm*—Snell & Wilmer, L.L.P.

(57) ABSTRACT

A method and apparatus for resurfacing a polishing pad using non-abrasive techniques. These techniques include shaving, milling, or planing the upper working surface of the polishing pad using an edged cutting tool to alter the microtexture and micro-topology of the surface to produce a desired surface contour or planarity. This precise conditioning of the microscopic features of the polishing pad surface controls dishing in workpieces during polishing.

20 Claims, 7 Drawing Sheets

NON-ABRASIVE CONDITIONING FOR POLISHING PADS

BACKGROUND OF THE INVENTION

1. Field of the Invention

The present invention relates generally to the polishing of semiconductor wafers utilizing chemical mechanical polishing technologies, and more particularly, the present invention relates to conditioning the surfaces of polishing pads used therein.

2. Background of the Related Art

The advances in integrated circuit device technology have necessitated the advancement of chemical mechanical polishing (CMP) technology to provide better and more consistent surface planarization processes. The manufacture of these devices (i.e. CMOS, VLSI, ULSI, microprocessors, semiconductor memory, and related technologies) on prepared substrates and the preparation of the substrates themselves (prime wafer polishing) require very highly planar and uniform surfaces. To achieve these high levels of planarity and uniformity on substrate surfaces, the processes that produce them must be performed reliably and consistently. Surfaces that are underpolished, overpolished, nonuniform, and/or nonplanar will not produce quality microelectronic devices.

In CMP fabrication techniques, a free abrasive chemical slurry is often used along with a rotating polishing pad, linear polishing belt, or rotating drum to contact the workpiece surface and to polish and planarize that surface. Typical examples of these types of apparatus are described in U.S. Pat. No. 5,329,732, assigned to SpeedFam disclosing a rotating polishing pad polisher; PCT Publication WO 97/20660, assigned to Applied Materials disclosing a linear belt polisher; and U.S. Pat. No. 5,643,056, assigned to Ebara Corporation and Kabushiki Kaisha Toshiba disclosing a rotating drum polisher. The disclosures of the foregoing patents, in relevant part, are incorporated herein by reference.

In such prior art polishing methods, one side of the wafer is attached to a wafer carrier and the other side of the wafer is pressed against a polishing surface. In general, the polishing surface comprises a polishing pad or belt that can be formed of various commercially available materials such as blown polyurethane from Rodel in Scottsdale, Ariz. Typically, a water-based colloidal abrasive slurry such as cerium oxide, aluminum oxide, fumed/precipitated silica or other particulate abrasives is deposited upon the polishing surface. During the polishing or planarization process, the workpiece (e.g., silicon wafer) is typically pressed against the moving (e.g., rotating or linearly translating) polishing surface. In addition, to improve the polishing effectiveness, the wafer may also be rotated about its vertical axis and/or oscillated over the inner and outer peripheries of the polishing surface. When pressure is applied between the polishing surface and the workpiece being polished, the combined abrasive particles and chemicals within the slurry produce mechanical abrasion and chemical corrosion of the surface being polished, thereby removing material from the workpiece.

However, a severe disadvantage to these methods is that any imperfections in the polishing surface will be transferred to the workpiece surface leading to a lessening of polishing planarity and uniformity of that workpiece. For these reasons, it is paramount not only to correct for degradation of the polishing surface due to wear but also to correctly prepare the surface prior to use. The recent and continuing advances in semiconductor technology, including the use of novel materials and decreasing size geometries, forces the need to more closely control the regularity of the polishing processes. In particular, the use of soft metals such as copper as a replacement for the harder aluminum and tungsten in metal interconnects often produces irregular, nonplanar, and nonuniform polishing results when using polishing surfaces conditioned by currently known processes. A second type of device structure, namely shallow trench isolation (STI), also has the same difficulties.

It has been generally understood that non-uniform surface wear and bulk deformation of the pad are the most significant causes of nonplanar and non-uniform polishing results. To alleviate this problem, multiple methods have been developed to recondition the surface of the pad. These methods are primarily abrasive in form as described in U.S. Pat. No. 5,486,131 assigned to SpeedFam that discloses an oscillating and rotating abrasive coated ring assembly. The most commonly used abrasive grains are diamonds, although many other "superabrasive" materials have been used (e.g., silicon nitride, "SuperNexus", CBN—cubic boron nitride). A strong disadvantage to the use of these abrasive coated assemblies is the use of the abrasive particles themselves. Often abrasive grains are freed from the conditioning assembly during use. When these grains become embedded into the pad, the result is a scratch in the workpiece. Because the abrasive grains are significantly harder than the workpiece surface layers, a single scratch can be severe and effectively destroy the workpiece. Moreover, the use of these abrasive assemblies for conditioning the polishing surfaces to control non-uniform and non-planar polishing of copper, STI and other structures has proven to be very unsatisfactory.

Two of the most significant problems arising from non-uniform and non-planar polishing are dishing and erosion. Examples of these defects in the copper damascene process resulting from a prior art CMP process are illustrated in FIG. 1. Briefly stated, the copper damascene process involves the overfilling of trench and via structures formed in an oxide layer and then polishing the copper material to form the required interconnects and via structures on the wafer. As shown in FIG. 1, dishing 10 in the copper interconnect features is evidenced by the nonplanar, typically concave, surface of copper lines between proximate underlying oxide features 30 on the workpiece surface. Erosion 20 occurs when there are insufficient oxide or stop layer 40 features to "stop" the CMP process from overpolishing the soft copper 50. Such defects formed during the polishing process cause difficulties in subsequent steps of the microelectronic device fabrication such as in lithographic process steps. Other significant problems caused by these defects include premature circuit failures and completely defective devices. Further information regarding the difficulties involved in copper processing and methods of monitoring such processes can be found in U.S. Pat. No. 5,723,874, assigned to International Business Machines Corporation in relevant part incorporated herein by reference.

Other known techniques for dealing with dishing and erosion include die structure/density changes, stop layers, and altered masking techniques. However, adjusting the die structure may not be possible due to specific design rules or issues relating to significant cost increases. The use of alternative masking techniques also adds extra steps to the fabrication process thereby further increasing costs and complexity.

Presently known techniques are unsatisfactory in correcting dishing and other irregular polishing processes in soft state-of-the-art materials. In addition to providing unsatisfactory results, these techniques also require the use of methods that are prohibitively costly or complex. Therefore, there is a need for apparatus and methods that will eliminate these effects, thereby permitting a higher degree of planarization and uniformity over the entire surface of the workpiece.

SUMMARY OF THE INVENTION

A principal object of the present invention is to provide methods and apparatus for controlling planarity and uniformity of substrate surfaces during polishing.

A further object of the present invention is to provide improved methods and apparatus for the conditioning of polishing pads.

Another object of the present invention is to provide improved control of the microtexture and micro-topology of the polishing pad surface through improved conditioning.

Another object of the present invention is to provide improved conditioning of polishing pads that results in reduced polishing non-uniformity and increased workpiece planarity.

Still another object of the present invention is the elimination of fixed abrasive particles, commonly diamonds, from the conditioning device which when dislodged therefrom, embed themselves into the polishing pad and cause scratching or other damage to the workpieces.

Yet another object of the current invention is the elimination of pad conditioning methods that abrade or scrape the pad surface, thereby rupturing and tearing the walls of the cellular bodies of the polishing pad surface causing non-uniformity and non-planarity in workpieces.

Briefly, the present invention provides a gantry-mounted and edged cutting tool for milling, planing, or shaving the surface of a polishing pad to improve polishing performance by removing microtextured features on the polishing pad surface in a regular and planar manner. The cutting edges of the tool contact the polishing pad surface in a nearly parallel direction allowing highly controlled "slicing" and removal of material from the surface. The tool is mounted to a gantry that moves the tool into and out of contact with and across the polishing surface. The gantry assembly may further provide a fixed-plane reference with positional feedback to eliminate runout and provide precise surface contouring. The system may further be computer controled for automated use.

BRIEF DESCRIPTION OF THE DRAWINGS

Specific details of the present invention will be better elucidated via inspection of the following description and figures of the prior art and present invention.

DETAILED DESCRIPTION OF THE PREFERRED EMBODIMENT

The present invention relates to a method and apparatus for improving a polishing surface for use in processing workpiece surfaces. Although the workpiece may comprise virtually any device requiring a controlled finish, the present invention is conveniently described with reference to semiconductor wafers that require a controlled, planar, and uniform surface finish. It will be understood by those skilled in the art, however, that the invention is not limited to any particular type of workpiece, polishing surface (e.g., pad, belt, lapping plate, etc.) or any particular type of workpiece surface finish. As the methods of operation and apparatus for performing these polishing and lapping functions are well known in the art, they will not be described in detail here. Only those portions of an exemplary apparatus that relate directly to the use of the present invention will be described.

Figure 1:
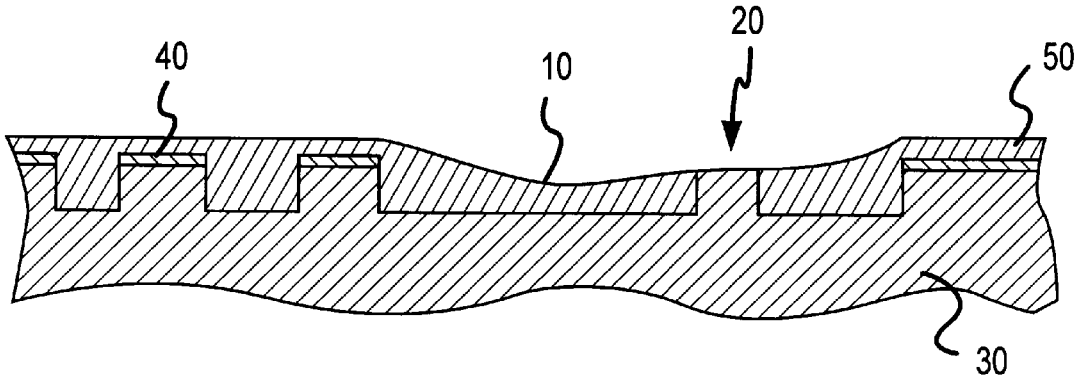
FIG. 1 is a simplified view of a damascene structure showing dishing and erosion.
Figure 2:
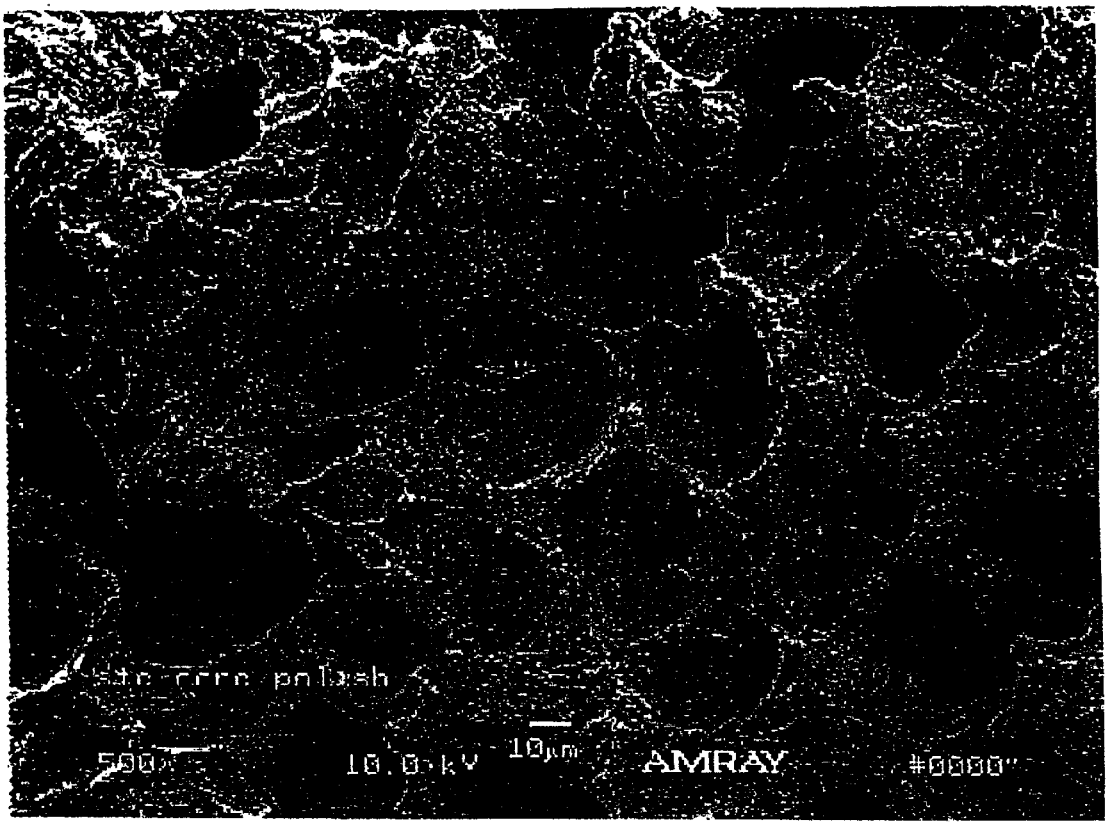
PRIOR ART FIG.2
FIG. 2 is an exemplary view of the microscopic surface texture of a polishing pad as conditioned by a prior art abrasive conditioner.
Figure 3:
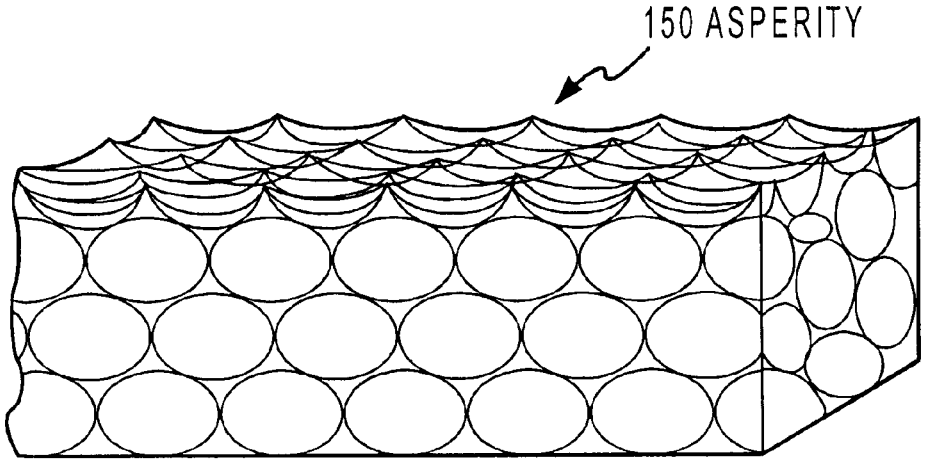
PRIOR ART FIG.3
FIG. 3 is an idealized representation of the microscopic surface texture of a polishing pad as conditioned by a prior art abrasive conditioner.
Figure 4:
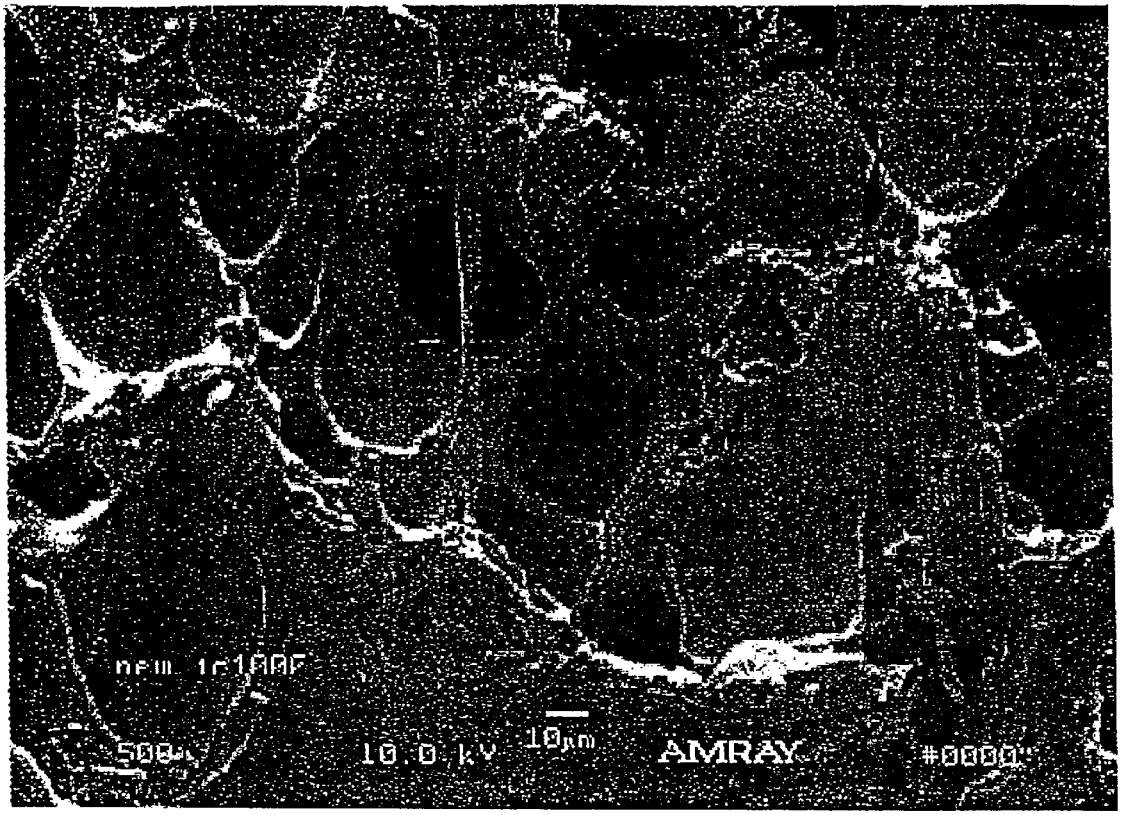
FIG. 4 is an exemplary view of the microscopic surface texture of a virgin (new, unused and unconditioned) polishing pad.

The present invention resulted from a scientific investigation into the nature and cause of the irregular polishing processes that arise during chemical-mechanical polishing. Surface textures and topologies of the variously modified polishing pad surfaces were investigated using microscopic techniques both optical and electron beam (SEM—Secondary Electron Microscopy). The resulting observations and relationships correlating the subsequent differences in workpiece surface quality to the preparation of the modified pads were determined. The elucidation of the changes in the surface of the polishing pad and the subsequent process difficulties caused by surface defects and corrected by the current invention are shown in contrast by the following series of figures: FIGS. 2 and 3; FIG. 4; and FIGS. 5 and 6.

Referring to FIGS. 2 and 3, FIG. 2 shows a highly magnified top view of the surface of an exemplary polishing pad as conditioned by a conventional 80-mesh abrasive polishing ring. FIG. 3 shows an idealized representation of the surface shown in FIG. 2. The pores of the pad, shown in FIGS. 2 and 3, illustrate that the abrasive conditioning process actually tears and destroys the cell walls of the pores during resurfacing. The resulting cell walls are very rough on a micron-size scale. The rupturing of the cells and the subsequent or simultaneous tearing of the cellular wall material occurs faster at locations that are thinner, such as between two adjacent cells, than at the junctions of multiple cells (3 or more) where there exists more material in the form of resinous post-like structures or asperities 150. These small asperities 150, which are on the order of 10 microns, act in a spring-like fashion and deform into the copper damascene structures to cause dishing and non-planar polishing on a microscopic (micron and sub-micron) scale. Previously, this type of microtexture roughness was not recognized or understood as being related to the dishing and erosion problems in copper polishing. Instead, the dishing and erosion problems were attributed to the bulk deformation of the pad into the surface texture of the workpiece. Therefore, past attempts at reducing these types of irregular polishing results focused on techniques such as the use of finer mesh abrasives (400-mesh) on the conditioning rings. Although these approaches have resulted in some improvement (1400 Angstroms vs. 1600 Angstroms of dishing), they remain very unsatisfactory.

FIG. 4 depicts a typical virgin (unused, unconditioned) pad surface microtexture. Notably, although the cell walls are plastically distorted due to the slicing process used during manufacturing, the bi-cellular walls are not cupped or ground away as in the abrasively conditioned pad surface shown in FIGS. 2 and 3. More importantly, it was discovered that wafers polished on such a virgin pad showed significant reduction in copper structure dishing (1200 Angstroms) as compared to a used or abrasively conditioned pad (1600 Angstroms). Unfortunately, polishing with a virgin pad produces poor uniformity due to the typically uneven slicing and poor surface profiling or planarity that is produced during the process of manufacturing the pad.

Figure 6:
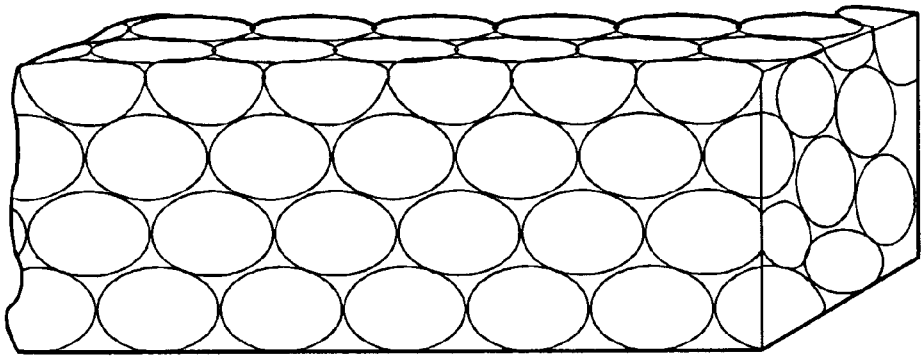
FIG. 6 is an idealized representation of the microscopic surface texture of a polishing pad as conditioned by the method and apparatus of the present invention.
Figure 5:
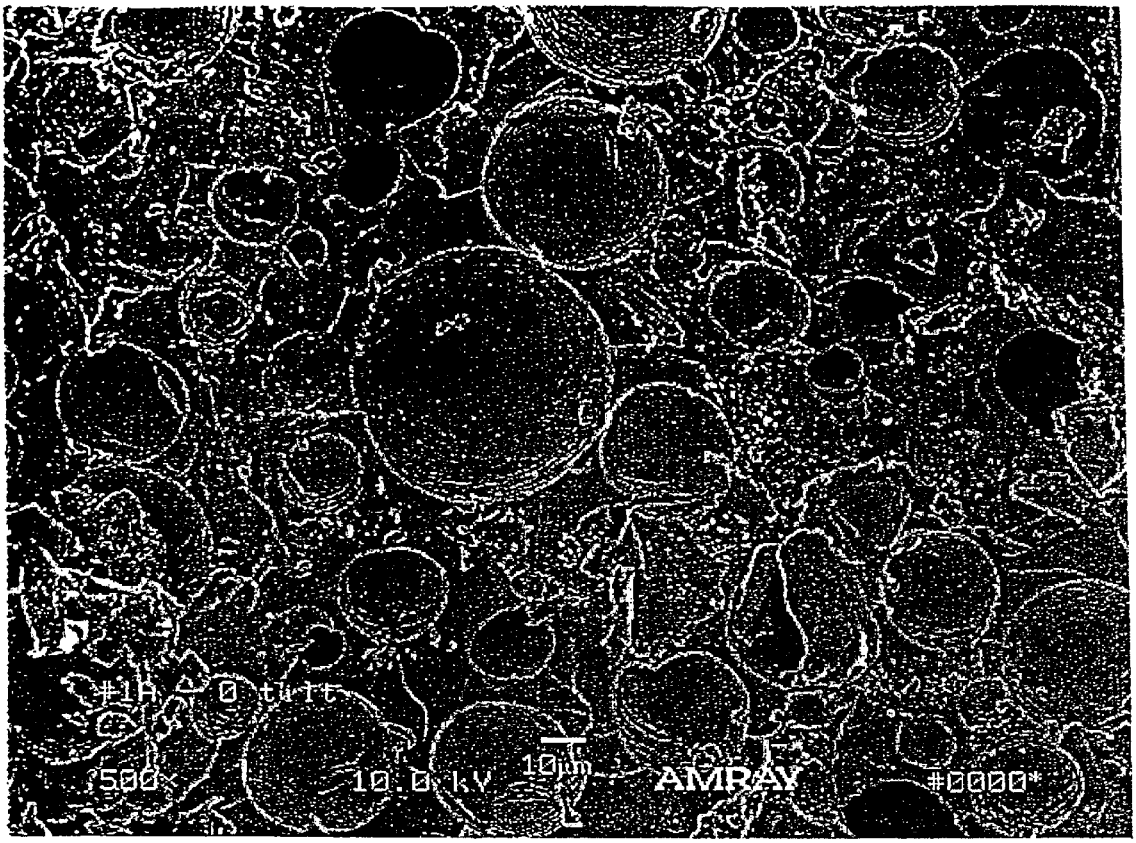
FIG. 5 is an exemplary view of the microscopic surface texture of a polishing pad as conditioned by the method and apparatus of the present invention.

FIG. 5 shows a highly magnified top view of the surface of an exemplary polishing pad as conditioned by the methods and apparatus in accordance with the present invention. An idealized schematic view of the microscopic surface texture of this so conditioned polishing pad is shown in FIG. 6. In contrast to the abrasively conditioned surfaces depicted in FIGS. 2 and 3, FIGS. 5 and 6 show a highly planar surface with cleanly defined cellular walls and multi-cellular junctions with the elimination of the asperities that interfere with planarity. This effective conditioning removes any loaded, glazed, or compacted debris out of the pad microstructure, and profiles all the cell walls and intercellular posts in a planar fashion. Moreover, the method and apparatus of the present invention re-cuts the pad similar to the virgin surface but with a correct profile that results in the posts being cleaved or cut coplanar with the cell walls. Accordingly, the nap of the pad surface is reduced and planarity of polished workpieces is improved thereby resulting in higher quality polished workpieces.

The present invention and its multiple embodiments of various forms of bladed cutting tools perform these improved pad conditioning operations which result in conditioned pads that produce higher quality and less dished or eroded workpieces. The processes of cutting the pad to condition generally involves the use of a bladed or edged tool, wherein the cutting edge of the tool contacts the pad in a nearly parallel orientation and moves relative and nearly parallel to the polishing pad surface, removing a thin layer of material from the pad surface. The above described slicing or shaving motion is preferably obtained by rotating the blade about an axis that is nearly perpendicular to the surface of the polishing pad.

Figure 7:
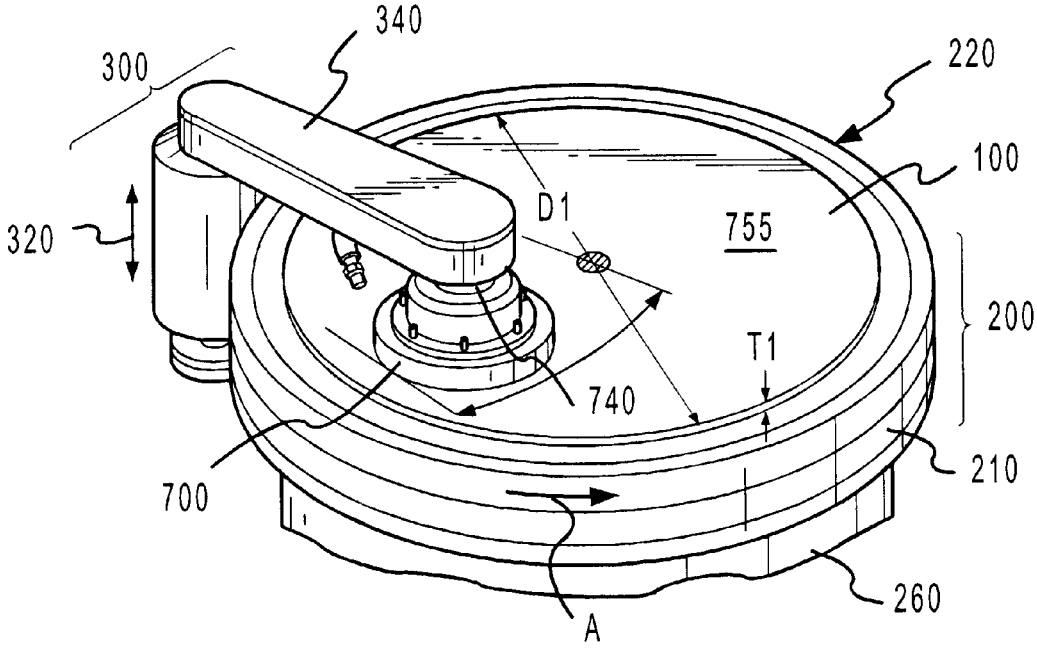
PRIOR ART FIG.7
FIG. 7 is a perspective view of a platen assembly including a conditioning gantry that may incorporate the present invention.

FIG. 7 depicts an exemplary platen assembly 200 and conditioning assembly 300 in accordance with the present invention. Platen assembly 200 includes a platen 210 with platen surface 220. The platen assembly 200 is mounted for rotation in a direction A, preferably counter-clockwise, on platen support 260. A polishing pad 100 with a polishing surface 755 is affixed to the platen surface 220 using well-known methods. The surface 755 of pad 100 may be shaped to enhance the polishing process; however, it is preferably a substantially planar surface characterized by relatively few surface irregularities. Polishing pad 100 may be comprised of a variety of materials such as polyurethane, felt, fabric, and the like.

In a preferred embodiment, polishing pad 100 has a diameter D1 of 25 to 40 inches (most preferably, 32 inches) and a thickness T1 of 0.04 to 0.15 inches (most preferably, 0.050 inches). Pad 100 may also be comprised of multiple layers that are often formed of different materials (e.g., top layer is a material of type IC-1000 and the bottom layer is a material of type Suba IV both as manufactured by Rodel of Scottsdale, Ariz.). A conditioning gantry assembly 300, positioned to overhang the platen assembly 200, includes a z-axis actuator 320 that raises and lowers a radially oscillating arm 340, and a conditioning tool 700 attached by a spindle 742 to the end of arm 340. Motors, linear actuators, ball screws, hydraulic mechanisms, or other similar mechanisms that are well known in the art may be used as a system for controlling a three dimensional position and speed to control the motion of conditioning tool 700, arm 340, and z-axis (normal to the polishing surface) actuator 320.

Figure 8A:
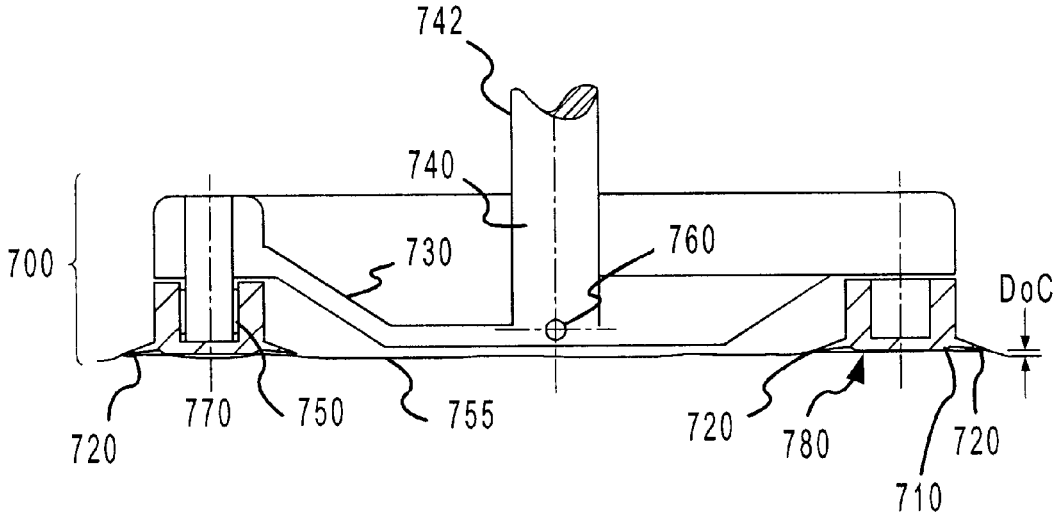
FIG. 8A is a first embodiment of the cutting tool assemblies in accordance with the present invention.

In a preferred embodiment, FIG. 8A, a pad conditioning tool 700 is comprised of multiple cutters 710 with resharpenable or replaceable sharp edges 720 attached to a housing 730 that includes a bore 740 for receiving a spindle 742. Spindle 742 is preferably attached to housing 730 so as to provide free universal gimbaling motion of housing 730 with respect to spindle 742 about gimbal point 760. The cutters are moveably mounted to the assembly via bearings 750 that allow the cutters 710 to rotate freely with respect to housing 730. The cutters 710 may also be geared to rotate about their own axis 770 under the effects of a drive motor. For optimal performance, the cutters 710 each have a planar area 780 proximate to the cutting edges to allow for "floating" or self-leveling of the cutters. The surface area of area 780 and an offset distance DoC, as measured perpendicular to the polishing pad surface, from the surface 780 to the edge of the cutters 710 allow for controlling the depth-of-cut. Smaller values of distance DoC and greater surface areas for area 780 result in shallower depths-of-cut into the polishing pad surface, whereas; the opposite conditions result in a deeper depth-of-cut. The conditions may be adjusted independently for optimal performance of the pad conditioner. The stability and performance of the assembly may be further enhanced by a low gimbal point 760 or rigidly mounted to ensure higher planarity.

Figure 8B:
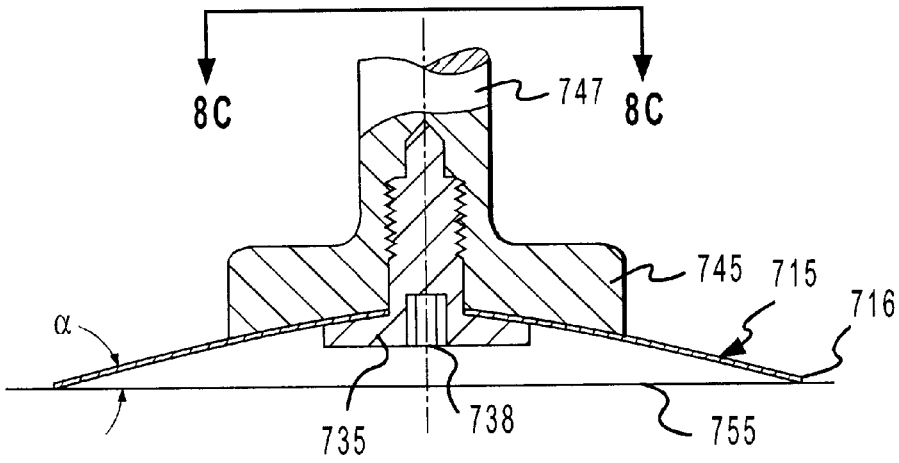
FIGS. 8B and 8C are side and top views, respectively, of a second embodiment of the cutting tool assemblies in accordance with the present invention.
Figure 8C:
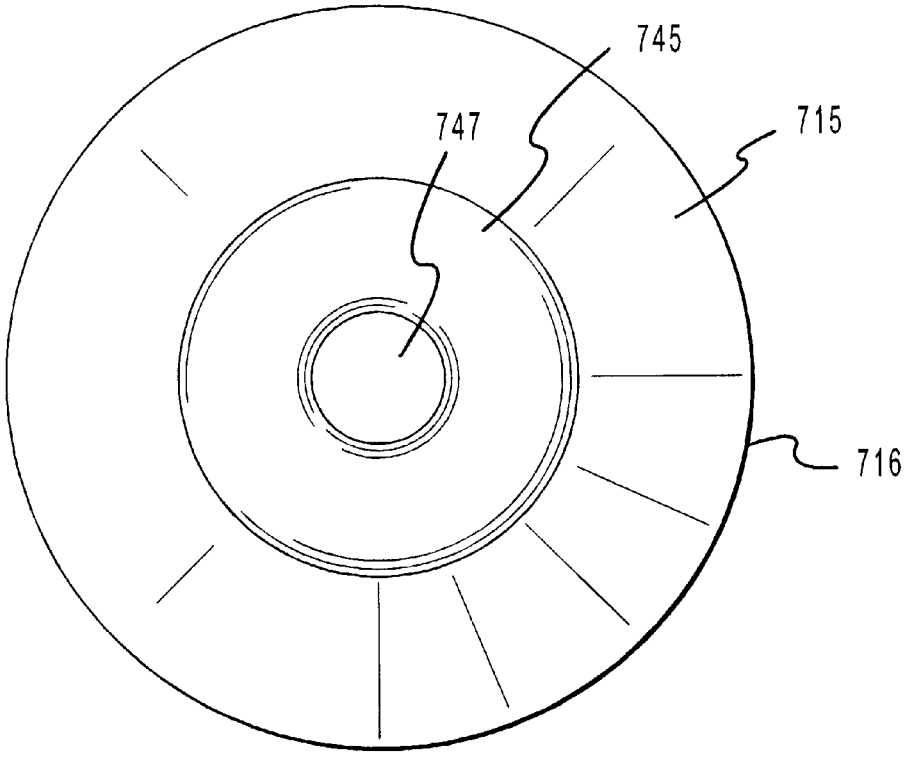

In another preferred embodiment of the present invention as shown in FIGS. 8B and 8C, a single edged cutting blade 715 having a cutting edge 716 is mounted to a coupling 745 that is either mounted to, or formed as part of, a spindle 747. The blade 715 is secured to coupling 745 by flange 735 and retaining screw 738. The blade 715 may be thin and flexible or rigid; and the edge 716 of the cutting blade 715 forms a small angle $\alpha$ with respect to the polishing pad surface 755. The blade 715 is preferably comprised of a hardened, coated, wear and corrosion resistant steel. However, the cutting blade 715 may also be formed from ceramics or other suitable materials such as tungsten carbide. Additionally, the edge 716 of the blade 715 may be formed into a scalloped or saw-toothed shape to further control the dynamic of operation of the blade 715. The scalloped and/or saw-toothed edge 716 of the blade 715 may have a fixed or variable pitch contour (spacing of repeat units of the edge, ie., the teeth or scallops) that may be selected based upon the operating parameters of the invention (e.g., speed of rotation of the blade, or applied pressure). The teeth of a saw-toothed edge 716 may also be set to produce a specific kerf.

Alternatively, adequate results may be obtained, depending upon the particular application, with conventional milling or planing types of cutting tools. Suitable types, sizes, and configurations of "end mills", "face mills", and "slotting cutters" are commercially available from Kennametal Inc. in Latrobe, Pa., and Ingersoll Milling Machine Co., Inc. in Rockford, Ill. Suitable planing cutters are commercially available from companies such as JET Equipment & Tools; RB Industries, Inc.; and Makita Electric Works, Ltd., Japan who supply such blades as replacement parts for their equipment.

During operation of the preferred embodiments as described above, the actuator 320 is retracted, thereby lowering arm 340 and conditioning tool 700, causing the cutting edges or blades of the tool to contact the surface of the pad under a force that is specified by the user or by control algorithms within the polishing machine itself where appropriate. This action may take place in situ (during the polishing of workpieces) or ex situ (not during polishing) and provides a precise planar or contoured profile for the polishing pad surface. Typically this force should be near, but slightly greater than, zero to cause the tool to engage the pad without removing excessive material. Because the upper layer of the polishing pad is typically 0.050 inches, it is important to only remove a minimal amount of material to prolong the useable life of the pad. Therefore, the preferred depth of cut is in the range of 0.000 to 0.005 inches, most preferably 0.0005 to 0.0002 inches. As precise control is necessary, the system is designed with feedback and computer or "Programmable Logic Controller" (PLC) automation.

During conditioning, the "feed rate" or relative velocity of the cutting tool 700 with respect to the pad surface 755 as the tool 700 traverses the polishing pad is preferably in the range of 0.0 to 1.0 meters/second. Most preferably, this motion is 1 to 5 centimeters/second. This rate of motion is provided by the combined actions of the relative movement of the polishing surface (rotation, translation, etc.) and the oscillating arm 340 and conditioning tool 700. Alternatively, this motion may be produced solely by the motion of the polishing surface relative to a fixed conditioning tool.

The rotation of the cutters or blades that are part of the conditioning tool allows for further control over the conditioning function. As noted above, the blades may be "free-wheeling" or driven about their axes. When driven about their axes, the preferred rate or of rotation is within the range of 0 to 20,000 RPM, most preferably, in the range of 5,000 to 10,000 RPM. Optimal use of the rotation speed is significantly dependent upon the design (diameter, thickness, kerf, etc.), sharpness, feed-rate, and other features of the blade. For shaving and planing types of cutters, the faster speeds (5,000 to 10,000 RPM) and thinner blades are better, however; for milling type cutters, slower rotation speeds achieve better results. Insufficient speeds may result in damage and tearing of the polishing surface microstructure. Furthermore, excessive speeds may cause melting of the polishing pad material.

In another embodiment of the present invention, the support and motion of the cutting tool 700 may be supplied by an X-Y-Z orthogonal three-axis gantry (not shown). The gantry control is provided via computer or PLC system that is responsive to a control recipe and incorporates a feedback mechanism. Motion, coordinated with these axes, is provided by appropriate motors, linear actuators, ball screw, hydraulic mechanisms, or other similar methods that are well known in the art. Suitable sources for components for gantry assemblies are THK America in Schaumburg, Ill. a supplier of linear tracks, ball screws, ball splines, and related parts and assemblies. Another source for mechanical components is Thomson Industries, Inc. in Port Washington, N.Y. a supplier of linear guides and rails. Motion control systems, motors, and components may be provided by Kolhnorgen Motion Technologies Group in Radford, Va. Rockwell Automation/Allen-Bradley in Phoenix, Ariz. Siemens Energy & Automation, Inc. in Phoenix, Ariz., or Yaskawa Electric America, Inc. in Northbrook, Ill.

A system for controlling a three dimensional position and speed of the cutting tool relative to the polishing surface has been described above in the discussion of the control of the "feed rate", rotation of the cutters, the pressure of the cutters on the pad, the three axis gantry, and the motion of the cutting tool.

Although the present invention is set forth herein in the context of the appended drawing figures, it should be appreciated by those skilled in the art that the invention is not limited to the specific forms shown. Various other modifications, variations, and enhancements in the design and arrangement of the polishing apparatus as set forth herein may be made without departing from the spirit and scope of the present invention as set forth in the appended claims. For example, while the exemplary invention embodies a device for polishing semiconductor wafers, it should be understood that the invention is not limited to any particular type of workpiece such as device wafers, hard disks, or glass. Moreover, other embodiments of bladed tools for milling, planing, or shaving the pad, as well as other types of gantry structures, are possible.

We claim:

1. An apparatus for conditioning a polishing surface comprising:

a spindle;

a housing attached to said spindle; and a plurality of cutting members having cutting edges mounted to said housing in a circular geometry, said plurality of cutting members each having a planar area proximate to their cutting edges to allow for "floating" and self-leveling of said cutting members.

2. The apparatus of claim 1 wherein said cutting members are moveably mounted to the housing via bearings that allow the cutting members to rotate about an axis.

3. The apparatus of claim 2 wherein said cutting members are actively rotatable with respect to said housing by a drive motor.

4. The apparatus of claim 1 wherein said cutting edges of said cutting members are capable of being resharpened.

5. The apparatus of claim 1 wherein said cutting edges of said cutting members are replaceable.

6. The apparatus of claim 1 wherein said cutting edges of said cutting members are capable of slicing.

7. The apparatus of claim 1 wherein said spindle is attached to said housing by a gimbal.

8. An apparatus for conditioning a polishing surface comprising:

a spindle;

a housing attached to said spindle; and a plurality of cutting members having cutting edges mounted to said housing in a circular geometry, said plurality of cutting members each having a planar area proximate to their cutting edges to allow for "floating " and self-leveling of said cutting members;

wherein at least one of said cutting edges of said cutting members has a set pitch contour that is selected based upon an operating parameter wherein said operating parameter is a speed of rotation of said cutting member.

9. An apparatus for conditioning a polishing surface comprising:

a spindle; and a slicing blade mounted to said spindle, said blade having a cutting edge that forms a less than 90 degree angle with respect to the polishing surface for slicing said polishing surface.

10. The apparatus of claim 9 wherein said cutting edge of said blade is capable of being resharpened.

11. The apparatus of claim 9 wherein said blade is replaceable.

12. The apparatus of claim 9 wherein said cutting edge of said blade is capable of slicing.

13. The apparatus of claim 9 wherein said spindle is rotated about its axis by a drive motor.

14. An apparatus for conditioning a polishing surface comprising:

a spindle; and a cutting blade mounted to said spindle, said blade having a cutting edge that forms a less that 90 degree angle with respect to the polishing surface;

wherein the edge of said blade has a set pitch contour that is selected based upon an operating parameter wherein said operating parameter is a speed of rotation of said blade.

15. An apparatus for conditioning a polishing surface comprising:

a spindle attached to a housing;

at least one cutting tool attached to said housing via bearings that allow said cutting tool to rotate about an axis for slicing said polishing surface; and a system for controlling a three dimensional position and speed of said cutting tool relative to said polishing surface.

16. The apparatus of claim 15 wherein said system for controlling the three dimensional position and speed of said cutting tool comprises position and velocity feedback from a fixed reference plane.

17. The apparatus of claim 15 wherein said system for controlling the three dimensional position and speed of said cutting tool comprises an oscillating arm and z-axis motion control.

18. The apparatus of claim 15 wherein said system for controlling the three dimensional position and speed of said cutting tool comprises a three-axis gantry.

19. The apparatus of claim 15 wherein said system for controlling the three dimensional position and speed of said cutting tool is computerized.

20. The apparatus of claim 15 wherein said system for controlling the three dimensional position and speed of said cutting tool comprises a motion that results in near zero applied force between the cutting tool and the polishing surface.

* * * * *